United States Patent [19]

Tagawa

[11] 4,048,957

[45] Sept. 20, 1977

[54] MAGNETIC BRUSH DEVELOPING APPARATUS FOR ELECTROPHOTOGRAPHY

[75] Inventor: Kazuaki Tagawa, Tokyo, Japan

[73] Assignee: Ricoh Company, Ltd., Tokyo, Japan

[21] Appl. No.: 621,882

[22] Filed: Oct. 14, 1975

[30] Foreign Application Priority Data

Oct. 18, 1974 Japan ..... 49-120078

[51] Int. Cl.[2] ..... G03G 13/00

[52] U.S. Cl. ..... 118/653; 118/655; 118/658; 355/3 DD

[58] Field of Search ..... 118/637, 647, 653, 655, 118/656, 657, 658; 355/3 DD; 427/18

[56] References Cited

U.S. PATENT DOCUMENTS

| | | | |
|---|---|---|---|
| 3,641,980 | 2/1972 | Bickmore | 118/637 |
| 3,830,401 | 8/1974 | Benwood et al. | 118/637 |
| 3,876,106 | 4/1975 | Powell et al. | 118/637 |
| 3,881,446 | 5/1975 | Kurita et al. | 427/18 |
| 3,882,821 | 5/1975 | Katayama et al. | 118/637 |
| 3,900,001 | 8/1975 | Fraser et al. | 118/637 |

*Primary Examiner*—Henry S. Jaudon
*Attorney, Agent, or Firm*—Frank J. Jordan

[57] ABSTRACT

Rotating magnetic poles are arranged so that they set up a strong repulsive force at a particular angular position thereof so that toner particles may be thrown by centrifugal force onto a photoconductive member to perform cascade development. The magnetic poles may be disposed in either one or two cylindrical magnetic brushes. The brushes are arranged so that one of them slidingly contacts the surface of the photoconductive member after the cascade development is completed to perform magnetic brush development.

9 Claims, 6 Drawing Figures

MAGNETIC BRUSH DEVELOPING APPARATUS FOR ELECTROPHOTOGRAPHY

The present invention relates to a magnetic brush developing apparatus for electrophotography.

In electrophotography, it is common to form an electrostatic image on a photoconductive member and then develop the image by applying dark colored toner particles onto the photoconductive member. The thus formed toner image is then transferred to a copy sheet and fixed thereto thermally to provide a copy of an original document. Two methods are commonly utilized to apply the toner particles to the photoconductive member. One is called cascade development in which the toner particles are flung in a cascade onto the photoconductive member. This developing method is particularly well suited to line images since it can reproduce lines very sharply due to the inherent edge effect. Another developing method involves a magnetic brush formed of toner particles attracted to a rotating magnetic member. This method is well suited to provide high contrast and resolution of solid black areas of copies. However, a method has heretofore not been provided which incorporates the benefits of both of these methods.

It is therefore an important object of the present invention to provide a magnetic brush developing apparatus in which the magnetic fields of two magnetic brushes combine to direct a cascade of toner particles onto a photoconductive member and one of the magnetic brushes subsequently contacts the surface of the photoconductive member to perform magnetic brush development.

The above and other objects, features and advantages of the present invention will become clear from the following detailed description taken with the accompanying drawings, in which.

Figure 1:
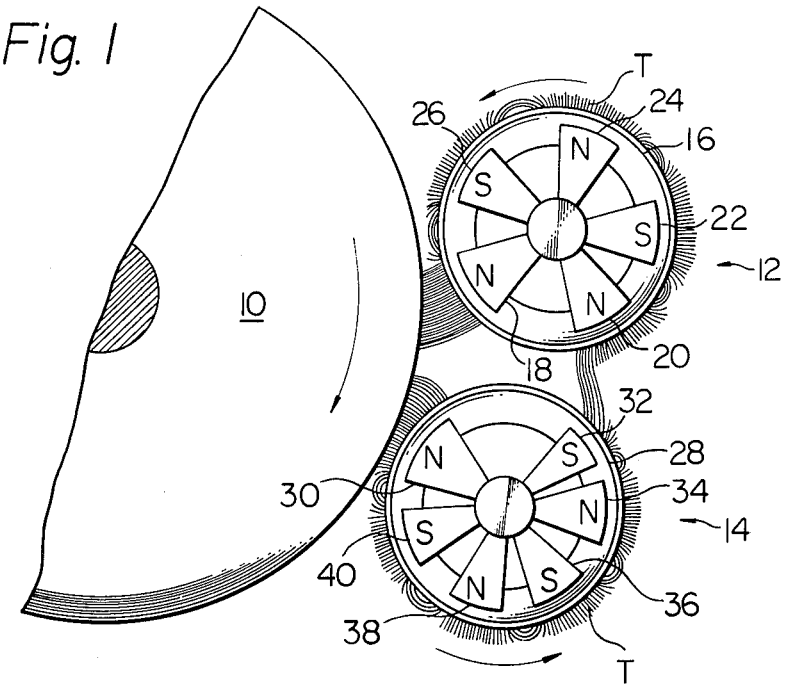
FIG. 1 is a schematic view of a first embodiment of the invention.

Referring now to FIG. 1, a photoconductive drum 10 is rotatable clockwise as shown by an arrow. The drum 10 may be of any known type and is assumed to have been imaged so that an electrostatic image is formed thereon. Magnetic brush means 12 and 14 are disposed adjacent to each other and to the drum 10 as shown and are rotatable counterclockwise as shown by arrows. The magnetic brush means 12 comprises a non-magnetic cylindrical member or sleeve 16 and magnets 18, 20, 22, 24 and 26 which have north (N) and south (S) poles oriented radially outward as shown in the drawing. The magnetic brush means 14 similarly comprises a non-magnetic cylindrical member or sleeve 28 and magnets 30, 32, 34, 36, 38 and 40. Ferromagnetic toner particles designated as T are attracted to the outer surfaces of the members 16 and 28 to form magnetic brushes.

In the embodiment shown in FIG. 1, the sleeve 28 is disposed closer to the drum 10 than the sleeve 16 so that the toner particles adhered to the magnetic brush means 14 are in constant sliding contact with the drum 10.

Figure 2:
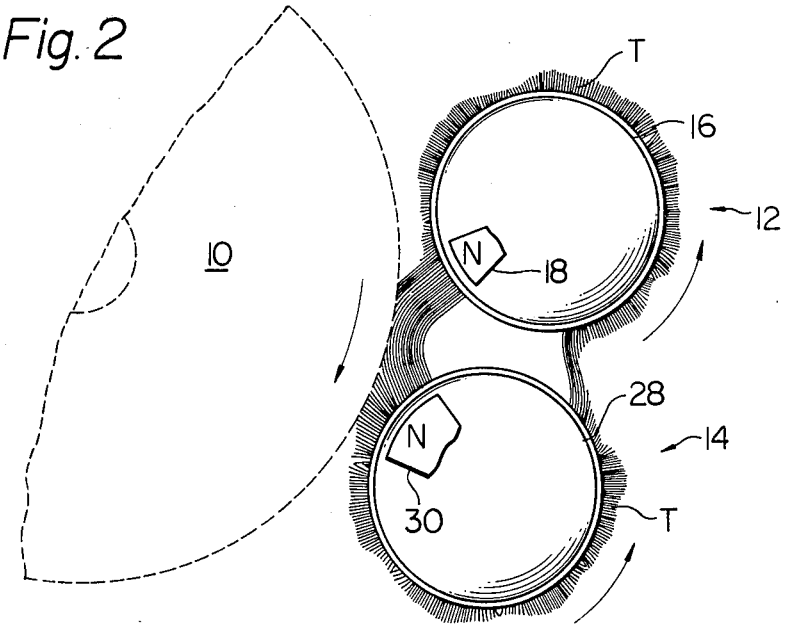
FIG. 2 is a graphic view showing the embodiment of FIG. 1 in abstraction.

In operation, the drum 10 and magnetic brush means 12 and 14 are rotated as shown and toner particles T are fed thereto from a reservoir which is not shown in FIG. 1. When the magnetic brush means 12 and 14 reach the angular position shown in FIG. 1, the magnets 18 and 30 are adjacent to each other. Since the magnets 18 and 30 both have north poles oriented outward, the toner particles T attracted thereto are repelled as shown in the drawing. FIG. 2 shows the same embodiment with only the magnets 18 and 30.

Due to the centrifugal force caused by rotation of the magnetic brush means 12 and the combined forces of the magnets 18 and 30, the toner particles T adhered to the surface of the sleeve 16 adjacent to the magnet 18 are thrown onto a portion of the surface of the drum 10 in a parabolic path to perform cascade development. As the drum 10 and magnetic brush means 12 and 14 are rotated further, the toner particles T adhered to the portion of the sleeve 28 adjacent to the magnetic 30 slidingly contact the same portion of the drum 10 onto which the toner particles T were flung from the magnetic brush means 12 to perform magnetic brush development of the same portion. It is also possible to move the magnetic brush means 12 closer to the drum 10 so that the toner particles T adhered thereto constantly contact the surface of the drum 10. In this case, magnetic brush development of each portion of the drum 10 is performed followed by cascade development followed by magnetic brush development.

Figure 5:
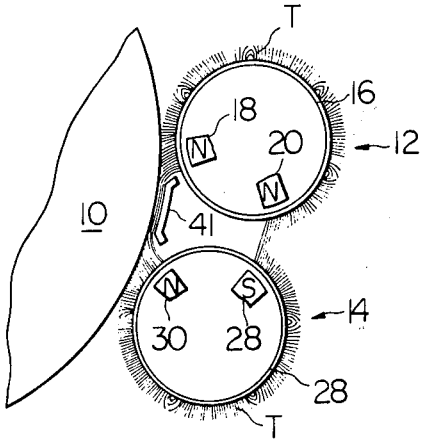

As shown in FIG. 5, it is possible to provide a counterelectrode 41 between the magnetic brush means 12 and 14 adjacent to the drum 10 to facilitate cascade development.

Figure 3:
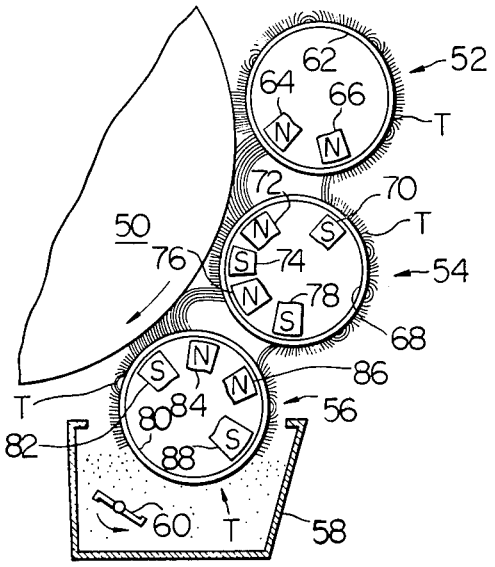
FIG. 3 is similar to FIG. 1 but shows a second embodiment.

As shown in FIG. 3, it is possible to provide any desired number of cascade and magnetic brush development stages. A photoconductive drum 50 is disposed adjacent to magnetic brush means 52, 54 and 56, with the magnetic brush means 56 being partially immersed in toner particles T in a reservoir 58. An impeller 60 is provided in the reservoir 58 to agitate the toner particles therein.

The magnetic brush means 52 comprises a cylindrical member 62 and magnets 64 and 66. The magnetic brush means 54 comprises a cylindrical member 68 and magnets 70, 72, 74, 76 and 78. The magnetic brush means 56 comprises a cylindrical member 80 and magnets 82, 84, 86 and 88.

In the embodiment shown in FIG. 3, cascade development is performed between the magnetic brush means 52 and 54, magnetic brush development is performed by the magnetic brush means 54, cascade development is performed between the magnetic brush means 54 and 56 and magnetic brush development is performed by the magnetic brush means 56.

FIG. 3 also illustrates a method of feeding toner pertic les T from the reservoir 58 to the magnetic brush means 52, 54 and 56. As shown, the magnetic brush means 56 is partially immersed in the toner particles T in the reservoir 58 and thereby directly picks up the toner particles T. The magnets 86 and 78 are arranged to be adjacent to each other at the angular position shown so that the toner particles T are transferred from the magnetic brush means 56 to the magnetic brush means 54 by magnetic attraction. It will be noticed that the toner particles on the magnetic brush means 56 adjacent to the magnet 86 are induced with a positive charge and that the toner particles on the magnetic brush means 54 adjacent to the magnet 78 are induced with a negative charge. The toner particles therefore attract each other and transfer is accomplished from the magnetic brush means 56 to the magnetic brush means 54. A similar transfer occurs between the magnets 70 and 66 to feed toner particles T to the magnetic brush means 52 from the magnetic brush means 54.

Figure 4:
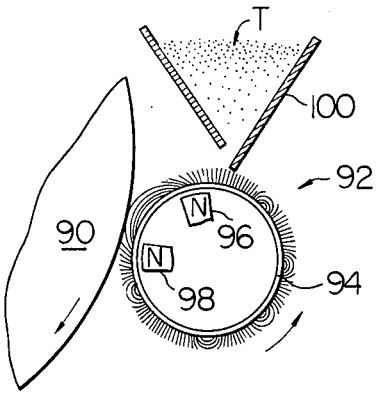
FIG. 4 to 6 are similar to FIG. 1 but show third to fifth embodiments.

As shown in FIG. 4, the first and second magnetic brush means may be combined into a single magnetic brush means 92, which comprises a cylindrical member 94 enclosing magnets 96 and 98 disposed adjacent to a photoconductive drum 90. In this embodiment, the magnetic brush means 92 is in constant contact with the drum 90. A reservoir 100 is disposed above the magnetic brush means 92 so that toner particles T are fed thereto by gravity. The bottom (no numeral) of the reservoir 100 contacts the toner particles T on the magnetic brush means 92 to remove excess toner particles T therefrom.

In operation, the combination of the magnetic forces of the magnets 96 and 98 and centrifugal force throws the toner particles T from the area of the magnet 96 onto the drum 90 and the portion of the magnetic brush means 92 adjacent to the magnet 98 subsequently performs magnetic brush development.

Figure 6:
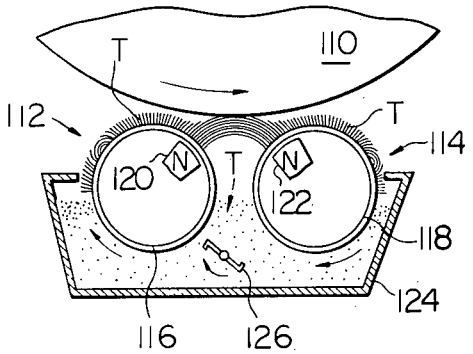

FIG. 6 shows still another embodiment of the invention in which magnetic brush means 112 and 114 are disposed below a drum 110. The magnetic brush means 112 comprises a cylindrical member 116 and a magnet 120. The magnetic brush means 114 comprises a cylindrical member 118 and a magnet 122. Both of the magnetic brush means 112 and 114 are partially immersed in the toner particles T in a reservoir 124 which is provided with an agitator impeller 126.

In operation, the combined magnetic fields of the magnets 120 and 122 in the angular position shown and centrifugal force cause toner particles T from the area of the magnetic brush means 112 near the magnet 120 to be thrown onto the drum 110 and the magnetic brush means 114 subsequently performs magnetic brush development.

Experiments were conducted of the apparatus shown in which the following parameters were utilized.

Embodiment of FIG. 1

- *Diameter of cylindrical member 16 . . . 60 mm
- *Nearest spacing between cylindrical member 16 and drum 10 . . . 5 mm
- *Diameter of cylindrical member 28 . . . 60 mm
- *Nearest spacing between cylindrical member 28 and drum 10 . . . 3 mm
- *Nearest spacing between cylindrical members 16 and 28 . . . 10 mm
- *Magnetic flux density on surface of cylindrical member 16 adjacent to magnet 18 . . . 800 gauss
- *Magnetic flux density on surface of cylindrical member 28 adjacent to magnet 30 . . . 700 to 800 gauss
- *Rotational speed of cylindrical members 16 and 28 . . . 50 to 150 rpm The experiments showed excellent results. It was also found that efficient transfer of toner particles from the magnetic brush means 14 to the magnetic brush means 12 occured when the magnetic flux density on the surface of the cylindrical member 16 adjacent to the magnet 20 was 700 to 800 gauss and the magnetic flux density of the surface of the cylindrical member 28 adjacent to the magnet 32 was 500 to 600 gauss.

Embodiment of FIG. 4

- *Diameter of cylindrical member 94 . . . 60 mm
- *Magnetic flux density on surface of cylindrical member 94 adjacent to magnet 96 . . . 500 to 600 gauss
- *Magnetic flux density on surface of cylindrical member 94 adjacent to magnet 98 . . . 600 to 800 gauss
- *Rotational speed of cylindrical member 94 . . . 50 to 150 rpm It was found that the toner particles T thrown from the magnetic brush means 92 onto the drum 90 attained a height of 10 mm above the surface of the cylindrical member 94. This height could be increased by increasing the rotational speed of the magnetic brush means 12, the force of the magnets 96 and 98 and/or the diameter of the cylindrical member 94.

In all of the embodiments the results of the experiments were excellent. It will thus be seen that the present invention will find utility in many types of electrophotographic apparatus and will increase the quality of copies produced by the apparatus since it provides both cascade and magnetic brush development. The toner T may comprise ferromagnetic colored particles or a combination of nonmagnetic colored particles mixed with a ferromagnetic carrier. Many modifications of the present invention within the scope thereof will become possible for those skilled in the art after receiving the teachings of the present disclosure.

What is claimed is:

1. A magnetic brush developing apparatus for applying toner particles to a photoconductive member, comprising, in combination, first and second rotary magnetic brush means which have the same magnetic polarity and are spaced from each other, said second magnetic brush means being disposed closer to the photoconductive member than the first magnetic brush means, said first magnetic brush means comprising a first non-magnetic cylindrical member with a first magnet mounted within the first cylindrical member, said second magnetic brush means comprising a second non-magnetic cylindrical member with a second magnet mounted within the second cylindrical member, and magnetic fields of the first and second magnetic brush means comprising at a first angular orientation of the first and second magnetic brush means to allow toner particles from the first magnetic brush means to be thrown by centrifugal force onto a portion of the photoconductive member to perform cascade development and the second magnetic brush means slidingly contacting the portion of the photoconductive member at a subsequent second angular orientation of the first and second magnetic brush means to perform magnetic brush development, said first and second magnets being arranged to be adjacent to each other at the first angular orientation of the first and second magnetic brush means such that magnetic fields thereof constitute said magnetic fields.

2. The apparatus of claim 1, in which the first and second magnetic brush means are arranged to rotate in a unitary manner.

3. The apparatus of claim 1, in which the first and second magnetic brush means are arranged to rotate in the same direction.

4. The apparatus of claim 1, in which the first and second magnetic brush means comprise third and fourth magnets respectively mounted within the first and second cylindrical members and spaced from the first and second magnets, one of the third and fourth magnets having the same polarity as the first and second magnets and the other of the third and fourth magnets having a polarity opposite to that of the first and second magnets.

5. The apparatus of claim 4, in which the third and fourth magnets are arranged to be adjacent to each other at a third angular orientation of the first and second magnetic brush means.

6. The apparatus of claim 4, further comprising a toner reservoir for the toner particles, the second magnetic brush means being partly immersed in the toner particles in the toner reservoir.

7. The apparatus of claim 1, further comprising a counterelectrode disposed between the first and second magnetic brush means and adjacent to the photoconductive member.

8. The apparatus of claim 1, further comprising a toner reservoir for the toner particles, the toner reservoir being disposed above the first magnetic brush means so that the toner particles are urged by gravity to flow from the toner reservoir onto the first magnetic brush means.

9. A magnetic brush developing apparatus for applying toner particles to a photoconductive member, comprising, in combination, first and second rotary magnetic brush means which have the same magnetic polarity and are spaced from each other, said second magnetic brush means being disposed closer to the photoconductive member than the first magnetic brush means, said first magnetic brush means comprising a first non-magnetic cylindrical member and a first and third magnet mounted within the first cylindrical member, said third magnet being spaced from said first magnet, said second magnetic brush means comprising a second non-magnetic cylindrical member with a second and fourth magnet mounted with the second cylindrical member, said fourth magnet being spaced from said third magnet, said first and second magnets having the same magnetic polarity, one of said third and fourth magnets having the same polarity as the first and second magnets and the other of said third and fourth magnets having a polarity opposite to that of said first and second magnets, and magnetic fields of the first and second magnetic brush means combining at a first angular orientation of the first and second magnetic brush means to allow toner particles from the first magnetic brush means to be thrown by centrifugal force onto a portion of the photoconductive member to perform cascade development and the second magnetic brush means slidingly contacting the portion of the photoconductive member at a subsequent second angular orientation of the first and second magnetic brush means to perform magnetic brush development.

* * * * *